United States Patent [19]

Hatanaka et al.

[11] Patent Number: 4,621,517

[45] Date of Patent: Nov. 11, 1986

[54] SYSTEM FOR AUTOMATICALLY CORRECTING POSITION OF SLIDE IN PRESS

[75] Inventors: Norio Hatanaka; Tsutae Hata; Yoshio Oketani; Eiji Kimura, all of Fukui, Japan

[73] Assignee: Fukui Machinery Co. Ltd, Fukui, Japan

[21] Appl. No.: 666,540

[22] Filed: Oct. 30, 1984

[30] Foreign Application Priority Data

Jun. 1, 1984 [JP] Japan ..... 59-113487

[51] Int. Cl.[4] ..... B21J 7/46

[52] U.S. Cl. ..... 72/441; 72/13; 72/21; 72/8

[58] Field of Search ..... 72/8, 13, 21, 27, 456, 72/441, 446, 389, 343; 100/255

[56] References Cited

U.S. PATENT DOCUMENTS

| | | | |
|---|---|---|---|
| 3,162,232 | 12/1964 | Munschauer, Jr. et al. | 72/441 |
| 3,628,358 | 12/1971 | Fapiano | 72/8 |
| 3,874,205 | 4/1975 | Roch et al. | 72/8 |
| 4,098,105 | 7/1978 | Fullers et al. | 72/21 |
| 4,148,203 | 4/1979 | Farazandeh | 72/21 |

FOREIGN PATENT DOCUMENTS

| | | | |
|---|---|---|---|
| 3200097 | 7/1983 | Fed. Rep. of Germany | 100/257 |
| 26503 | 7/1977 | Japan | 72/13 |
| 650833 | 4/1980 | U.S.S.R. | 100/257 |

*Primary Examiner*—Francis S. Husar
*Assistant Examiner*—David B. Jones
*Attorney, Agent, or Firm*—Armstrong, Nikaido, Marmelstein & Kubovcik

[57] ABSTRACT

A system for automatically correcting the position of the slide of a press comprises a position adjusting assembly for adjusting the up-down relative position relationship between the slide and a bolster while the press is in operation, a distance detecting unit for directly or indirectly detecting the relative distance between the bolster and the slide at the bottom dead center, and a control unit for controlling the position adjusting assembly based on the output of the distance detecting unit so that the relative distance between the bolster and the slide at the bottom dead center will be within a predetermined range during the operation of the press.

17 Claims, 12 Drawing Figures

SYSTEM FOR AUTOMATICALLY CORRECTING POSITION OF SLIDE IN PRESS

BACKGROUND OF THE INVENTION

The present invention relates to a system for automatically correcting the position of the slide in a press, and more particularly to a system for automatically adjusting the up-down relative position relationship between the slide and the bolster so that the relative distance between the bolster and the slide at the bottom dead center will be in a predetermined range.

In some kinds of press work, for example in coining operation, problems could arise from the degree of accuracy of the position of the bottom dead center, i.e. variations in the relative distance between the bolster and the slide at the bottom dead center. Such variations in the relative distance include the variation from stroke to stroke, the variation dependent on the number of successive strokes (spm), and the variation due to the thermal expansion of press components resulting from the heat of friction involved in the drive assembly of the slide. Of these variations, the stroke-to-stroke variation can be diminished sufficiently by designing and building the press with improved precision, but difficulties still remain to be eliminated in reducing the variation due to the succession of strokes or to heat to a small value, for example, of up to 10 $\mu$m. Accordingly it is usual practice to circulate a large quantity of oil through the press to prevent the rise of temperature, but this requires much power for the circulation of oil and temperature control and is therefore not economical. Further when the press is held out of operation and is brought into operation again, it is likely that the bottom dead center will not be accurately positioned. For example, the operation of the press is interrupted for the replacement or supply of die, coil material, or recoil material of worked product, and the temperature of the drive assembly for the slide gradually falls during the interruption, gradually altering the position of the top dead center of the slide. This gradually alters the up-down relative position relationship between the slide and the bolster. Consequently, if the press in this state is brought into operation again, it is likely that the relative distance between the bolster and the slide at the top dead center will be outside a predetermined range.

SUMMARY OF THE INVENTION

An object of the present invention is to provide a system for holding the bottom dead center positioned with improved accuracy during the operation of the press without necessitating particular temperature control.

Another object of the invention is to provide a system for positioning the bottom dead center with improved accuracy when the operation of the press is resumed.

The invention provides asystem for automatically correcting the position of the slide of a press, comprising a position adjusting assembly for adjusting the up-down relative position relationship between the slide and a bolster while the press is in operation, a distance detecting unit for directly or indirectly detecting the relative distance between the bolster and the slide at the bottom dead center, and a control unit for controlling the position adjusting assembly based on the output of the distance detecting unit so that the relative distance between the bolster and the slide at the bottom dead center will be within a predetermined range during the operation of the press.

With the system of the present invention, the up-down relative position relationship between the slide and the bolster is adjusted during the operation of the press so that the relative distance between the bolster and the slide at the bottom dead center will be within a predetermined range for correction, whereby the bottom dead center can be positioned in place with improved accuracy without resorting to temperature control heretofore done. Unlike the conventional apparatus, the present system does not require power for circulating a large quantity of oil and, hence, is economical.

The present invention further provides a system for automatically correcting the position of the slide of a press which system comprises a position adjusting assembly for adjusting the up-down relative position relationship between the slide and a bolster, a temperature detecting unit for detecting the temperture of the drive assembly for the slide while the slide is out of operation, and a control unit for controlling the position adjusting assembly based on the output of the temperature detecting unit while the slide is out of operation so that:the position of the top dead center of the slide will be within a predetermined range.

Thus, even while the slide is at rest, the up-down relative position relationship between the slide and the bolster is adjustable by the present system so as to be within the predetermined range. This assures that the bottom dead center will be in definite position with high accuracy immediately after the press is returned into operation.

The present invention further provides a system for automatically correcting the position of the slide of a press, the system comprising a position adjusting assembly for adjusting the up-down relative position relationship between the slide and a bolster while the press is in operation, a distance detecting unit for directly or indirectly detecting the relative position between the bolster and the slide at the bottom dead center, a temperature detecting unit for detecting the temperature of the drive assembly for the slide at rest, and a control unit for controlling the position adjusting assembly based on the output of the distance detecting unit while the press is in operation so that the relative distance between the bolster and the slide at the bottom dead center will be within a predetermined range, the control unit further being adapted to control the position adjusting assembly based on the output of the temperature detecting unit while the slide is at rest so that the position of the top dead center of the slide will be within a predetermined range.

Without resorting to particular temperature control, the system of the invention is adapted to position the bottom dead center in place with improved precision during the operation of the press and to position the bottom dead center in place with improved precision when the operation of the press is resumed.

DESCRIPTION OF THE PREFERRED EMBODIMENTS

Figure 1:
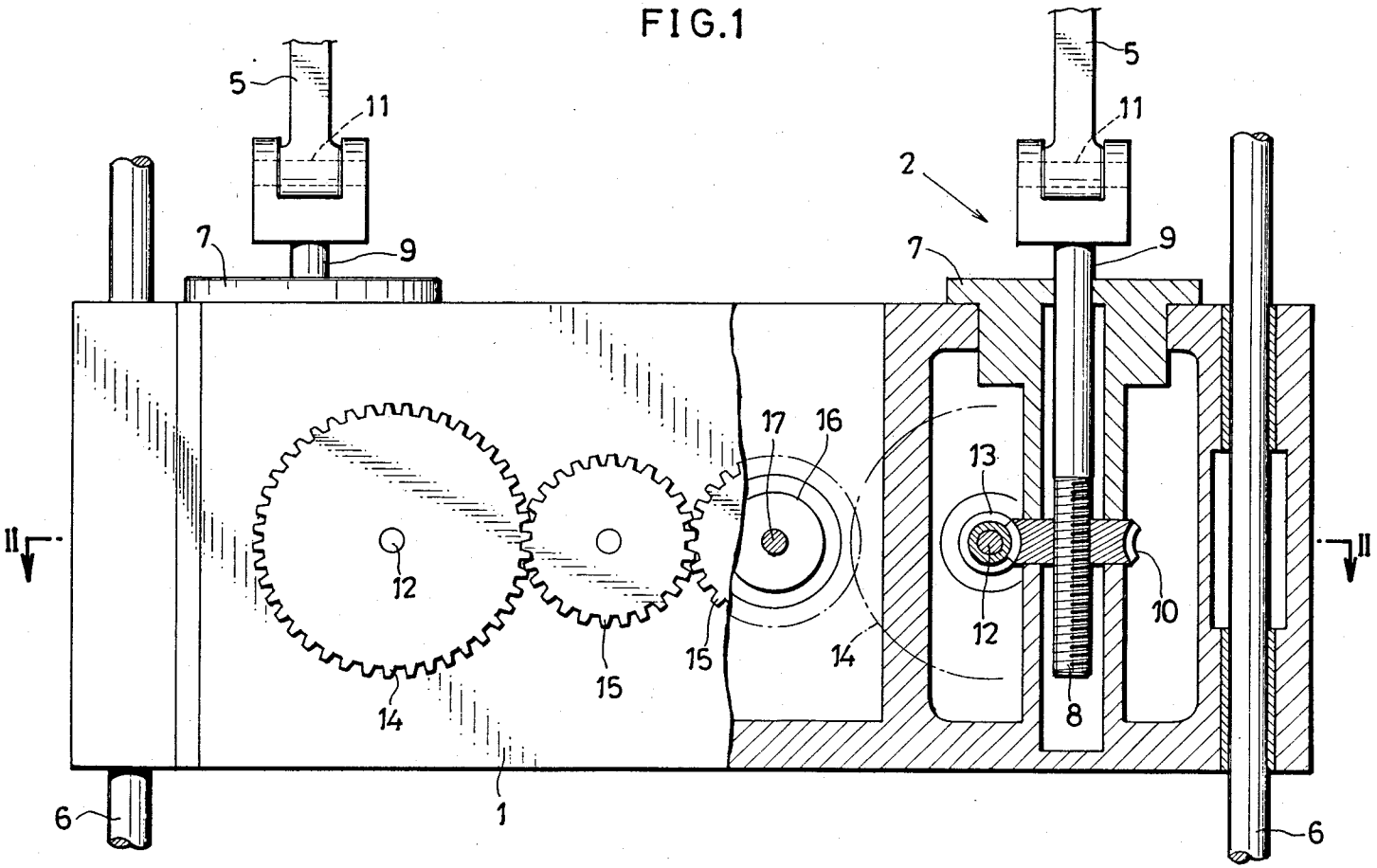
FIG. 1 is a front view partly broken away and showing a slide of a press and a slide position adjusting assembly provided therefor.
Figure 2:
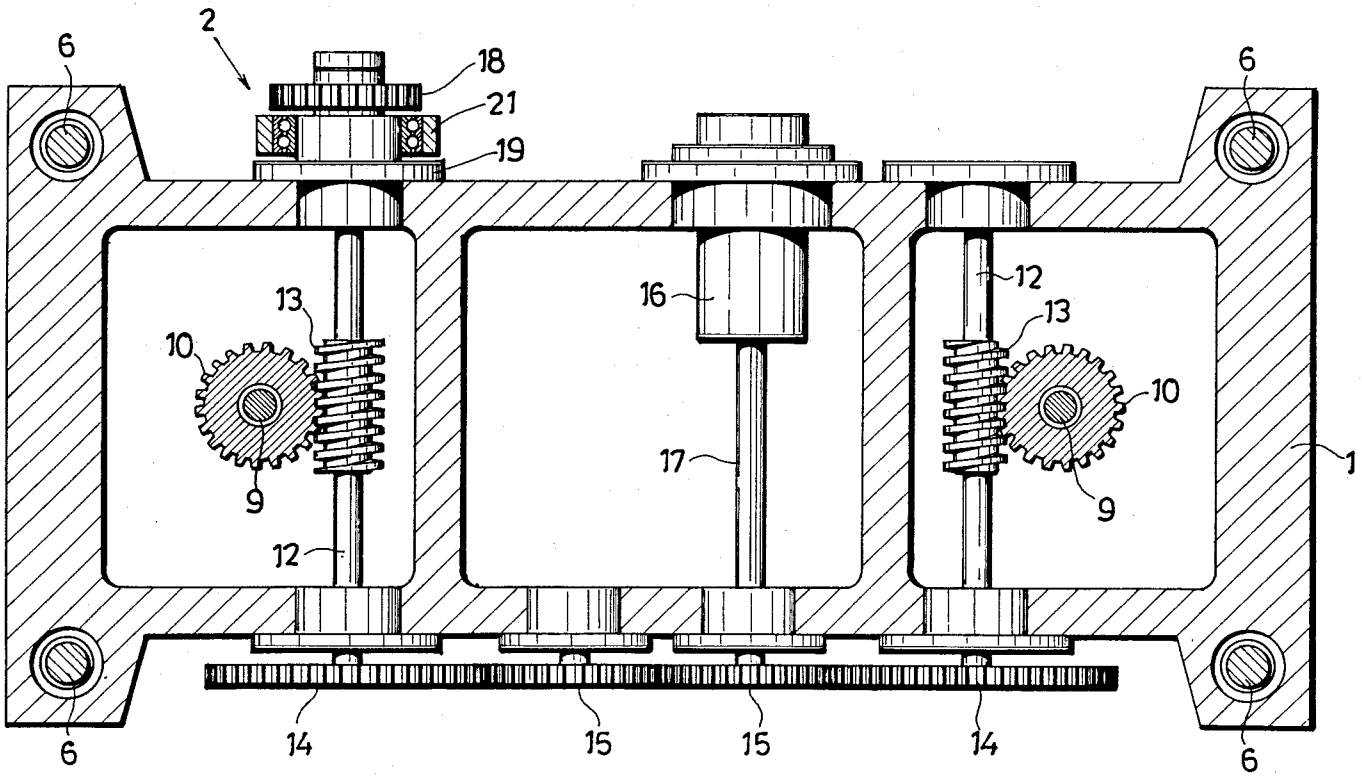
FIG. 2 is a view in section taken along the line II—II in FIG. 1.
Figure 3:
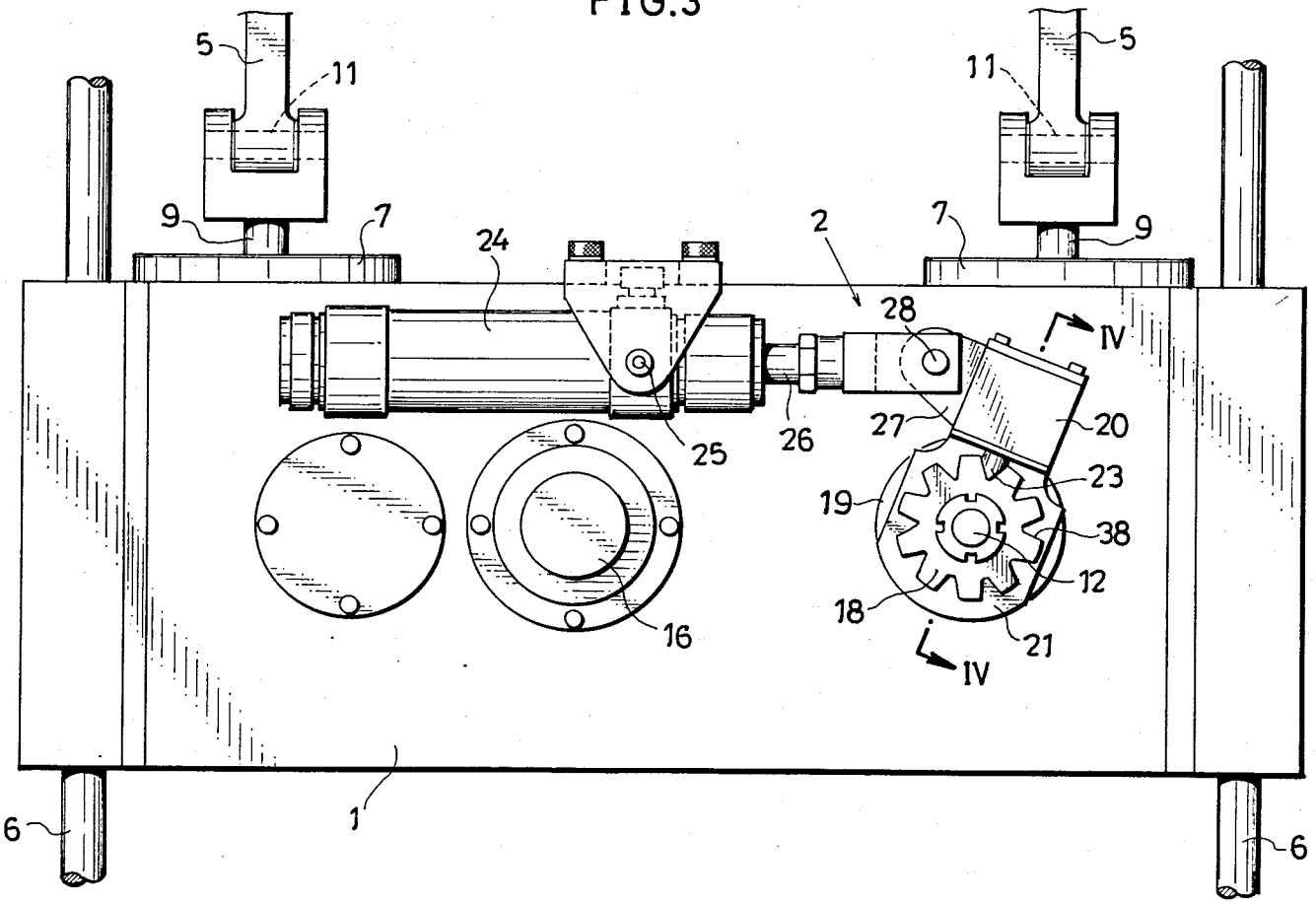
FIG. 3 is a rear view of FIG. 1.
Figure 4:
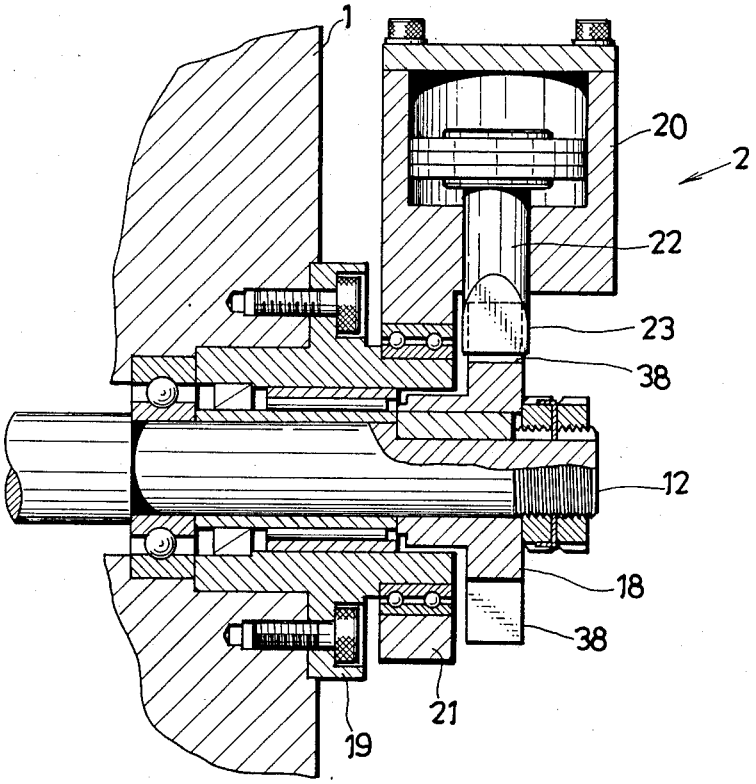
FIG. 4 is an enlarged view in section taken along the line IV—IV in FIG. 3.
Figure 5:
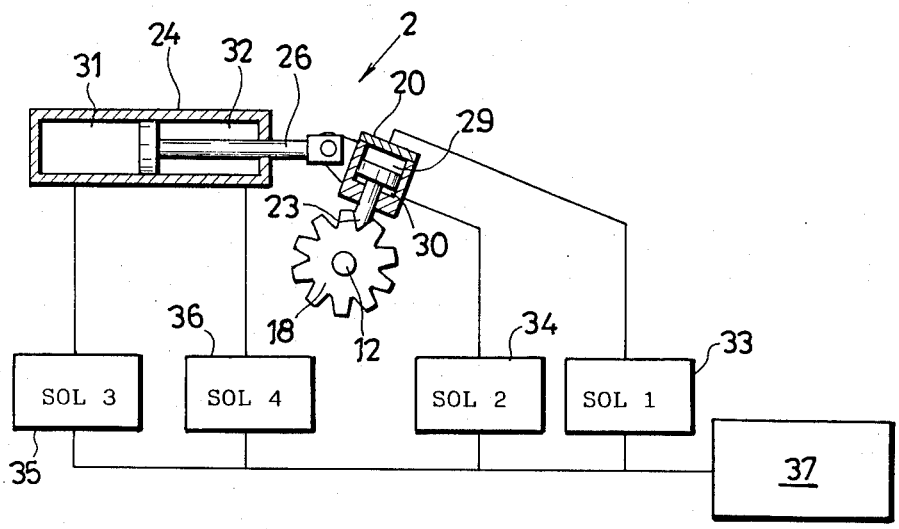
FIG. 5 is a diagram showing a pneumatic system for the slide position adjusting assembly.

The drawings show the slide 1 of a double crank press and a system for automatically correcting the position of the slide 1. The system comprises a slide position adjusting assembly 2 for adjusting the up-down relative position relationship between the slide 1 and a bolster (not shown) while the press is in operation, a distance detecting unit 3 for directly detecting the relative distance between the bolster and the slide 1 at the bottom dead center (hereinafter referred to as "minimum relative distance"), a temperature detecting unit 60 for detecting the temperature of the drive assembly for the slide 1, and a control unit 4 for controlling the position adjusting assembly 2 based on the output of the distance detecting unit 3 during the operation of the press so that the minimum relative distance will be within a predetermined range, the control unit 4 further having the function of controlling the position adjusting assembly 2 so that the position of the top dead center of the slide will be within a predetermined range, by determining the displacement of the top dead center of the slide 1 from the output of the temperature detecting unit 60 while the slide 1 is out of operation.

The slide 1 and the slide position adjusting assembly 2 attached thereto are shown in detail in FIGS. 1 to 5. The assembly 2 is adapted to adjust the up-down relative position relationship between the slide 1 and the bolster by adjusting the up-down relative position relationship between the slide 1 and connecting rods 5. The assembly 2 has the following construction. The slide 1 is box-shaped and vertically slidably supported by four vertical guide rods 6 at its four corners. A closure 7 is fixedly fitted to the upper side of the slide 1 toward each end of the slide 1. A vertical adjusting screw rod 9 having an externally threaded lower portion 8 vertically slidably extends through the closure 7 centrally thereof. A worm wheel 10, which is internally threaded, is screwed on the externally threaded portion of the screw rod 9. Each worm wheel 10 is rotatable but is prevented from moving vertically by being held between the slide 1 and each closure 7. The lower end of each connecting rod 5 is pivoted to the upper end of the screw rod 9 by a horizontal pin 11 extending longitudinally of the slide. The slide 1 is internally provided with two rotatable worm shafts 12 which extend horizontally transversely of the slide. A worm 13 fixedly mounted on each shaft 12 is in mesh with the corresponding worm wheel 10. The two worm shafts 12 are coupled to each other by gears 14 mounted on their front ends and two intermediate gears 15 and are rotatable in directions opposite to each other in synchronism. One of the intermediate gears 15 is fixed to the front end of the shaft 17 of an air motor 16 mounted on the slide 1. The rear end of one of the worm shafts 12 extends outward from the rear side of the slide 1 and fixedly carries an adjusting gear 18. A housing 19 fitted in the rear wall of the slide 1 from outside for supporting this worm shaft 12 has rotatably fitted therearound a bracket 21 integral with one end of a first air cylinder 20. The cylinder 20 is positioned at one side of the adjusting gear 18 and has a piston rod 22 projecting toward the gear 18. A pawl 23 meshing with the gear 18 is integral with the forward end of the piston rod 22. A second air cylinder 24 is rotatably supported at an intermediate portion by a horizontal pin 25 extending transversely of the slide and mounted on the rear wall of the slide 1 at an upper middle portion thereof. The cylinder 24 has a piston rod 26, the forward end of which is pivoted by a horizontal pin 28 extending transversely of the slide to a bracket 27 formed on an outer portion of the first cylinder 20 integrally therewith. The two chambers 29, 30 of the first cylinder 20 and the two chambers 31, 32 of the second cylinder 24 are in communication with a compressed air source 37 via solenoid valves 33, 34, 35 and 36, respectively.

Usually the first valve 33 and the fourth valve 36 are open (with the air source 37 in communication with the chambers 29, 32 of the cylinders 20, 24), and the second valve 34 and the third valve 35 are closed (with the chambers 30, 31 of the cylinders 20, 24 shut off from the air source 37 and held in communication with the atmosphere). In this state, the pawl 23 of the first cylinder 20 is in its advanced position, fitting in a space between teeth 38 of the adjusting gear 18, while the rod 26 of the second cylinder 24 is in its retracted position. The pawl 23 prevents the rotation of the adjusting gear 18, i.e. of the worm shafts 12, to hold the worm wheels 10 out of rotation. Accordingly the up-down relative position relationship between the worm wheels 10 and the adjusting screw rods 9, i.e. between the slide 1 and the connecting rods 5, remains unchanged, consequently holding the slide 1 and the bolster in a definite up-down relative position relationship.

When the up-down relative position relationship is to be adjusted in a direction in which the relative distance between the slide 1 and the bolster increases (this mode of adjustment will hereinafter be referred to as "plus adjustment"), the four valves 33 to 36 are controlled in the following manner. First, the first valve 33 is closed, and the second valve 34 is opened at the same time, whereby the pawl 23 of the first cylinder 20 is retracted out of engagement with teeth 38 of the adjusting gear 18, rendering the first cylinder 20 free to rotate relative to the adjusting gear 18. Next, the fourth valve 36 is closed, while the third valve 35 is opened at the same time. This advances the rod 26 of the second cylinder 24, rotating the first cylinder 20 clockwise in FIGS. 3 and 5 through a given angle. At this time, the adjusting gear 18 is at rest. Subsequently the second valve 34 is closed, and the first valve 33 is opened at the same time, whereby the pawl 23 is advanced again and fitted into another space between teeth 38 which is adjacent to the original space and away therefrom in clockwise direction in FIGS. 3 and 5. Finally the third valve 35 is closed, and the fourth valve 36 is opened at the same time. This retracts the rod 26 of the second cylinder 24 again, rotating the first cylinder 20 counterclockwise in FIGS. 3 and 5 to the original position. This rotation of the first cylinder 20 is transmitted to the adjusting gear 18 through the pawl 23, rotating the gear 18 counterclockwise in FIGS. 3 and 5 from the original position by an amount corresponding to one tooth. The rotation of the gear 18 is directly transmitted to the worm shaft 12 to which the gear is fixed and is further transmitted to the other worm shaft 12 via the gears 14, 15, 15, 14, whereby the two worms 13 are rotated in opposite directions through an equal angle. The rotation of the two worms 13 rotates the two worm wheels 10 in the same direction through the same angle, with the result that the two worm wheels 10 move upward relative to the screw rods 9 by the same amount. When the adjusting assembly 2 is thus operated by one cycle, the resulting amount of movement of the worm wheels 10 relative to the screw rods 9, i.e. the amount of adjustment, is for example 10 μm.

The valves are operated in the following manner to adjust the up-down relative position relationship in a direction in which the relative distance between the slide 1 and the bolster decreases (this mode of adjustment will hereinafter referred to as "minus adjustment"). First, the fourth valve 36 is closed, and the third valve 35 is opened at the same time. Next, the first valve 33 is closed, and the second valve 34 is opened at the same time. Subsequently the third valve 35 is closed, while the fourth valve 36 is opened at the same time. Finally, the second valve 34 is closed, while the first valve 33 is opened at the same time. In reverse relation to plus adjustment, the adjusting gear 18 is consequently rotated clockwise in FIGS. 3 and 5 from the original position by an amount corresponding to one tooth. This moves the two worm wheels 10 downward relative to the screw rods 9 by the same amount.

While the adjusting assembly 2 is in operation as described above, the air motor 16 is in a free state. The air motor 16 is adapted for greatly changing the up-down relative position relationship between the slide 1 and the connecting rod 5, for example, when the die is changed. The shaft 17, when rotated by the air motor 16, moves the two worm wheels 10 upward or downward relative to the screw rods 9 by the same amount in the same manner as above.

Figure 6:
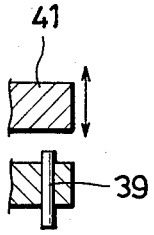
FIG. 6 is a view in vertical section showing a distance sensor included in a distance detecting unit.
Figure 7:
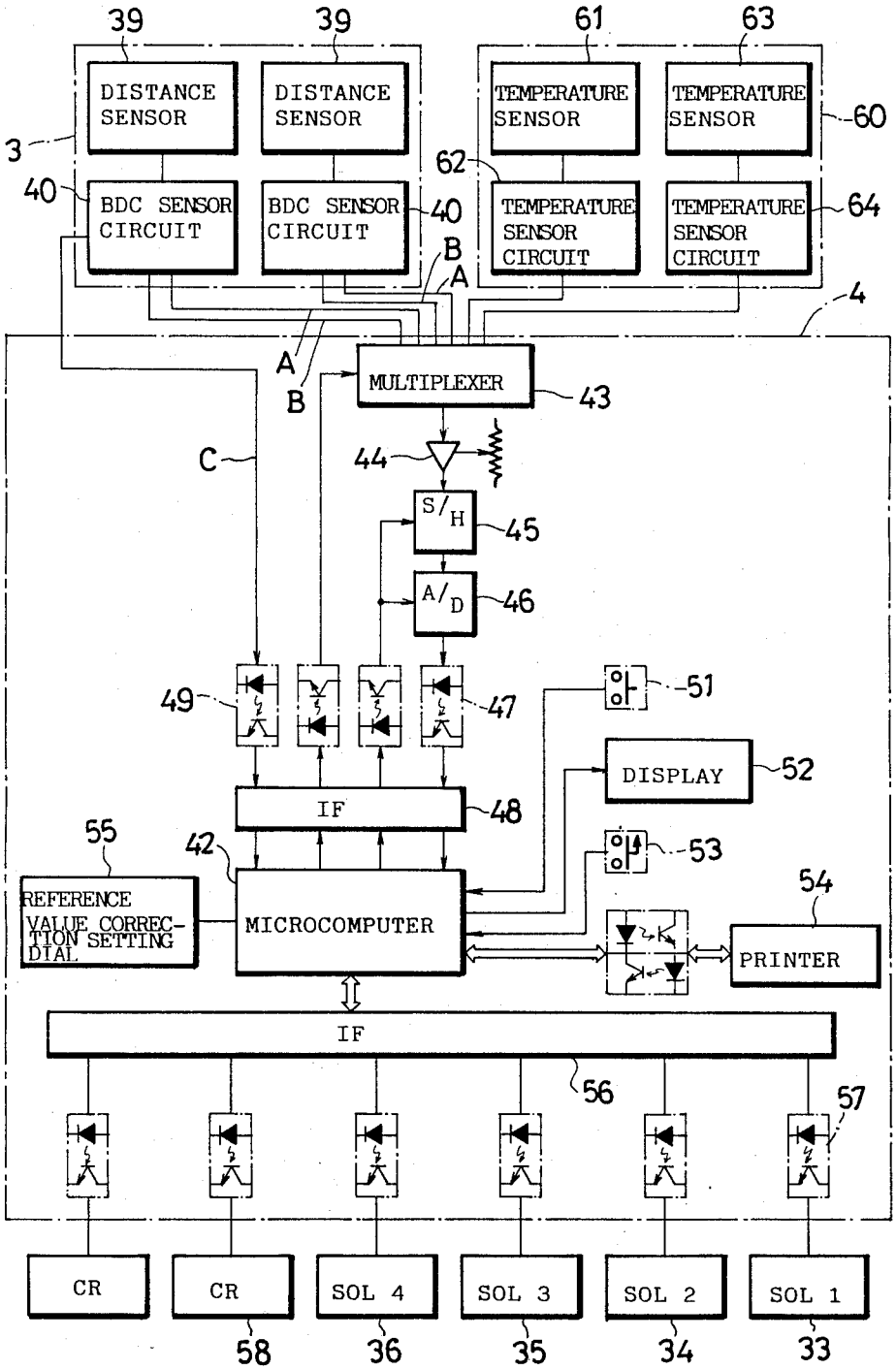
FIG. 7 is a block diagram showing the distance detecting unit, a temperature detecting unit and a control unit.

With reference to FIGS. 6 and 7, the distance detecting unit 3 comprises two distance sensors 39 and two bottom dead center sensor circuits 40 connected thereto respectively. For example, the sensor 39 is a non-contact type sensor for detecting a displacement by making use of an eddy current effect. For the adjustment of position in upward-downward direction, the sensors are fixedly mounted, as oriented upward, on the left front portion and right rear portion of the bolster by suitable means. On the other hand, the slide 1 is fixedly provided with two blocks 41 to be detected which are positioned immediately above the two sensors 39 in corresponding relation thereto.

Figure 8:
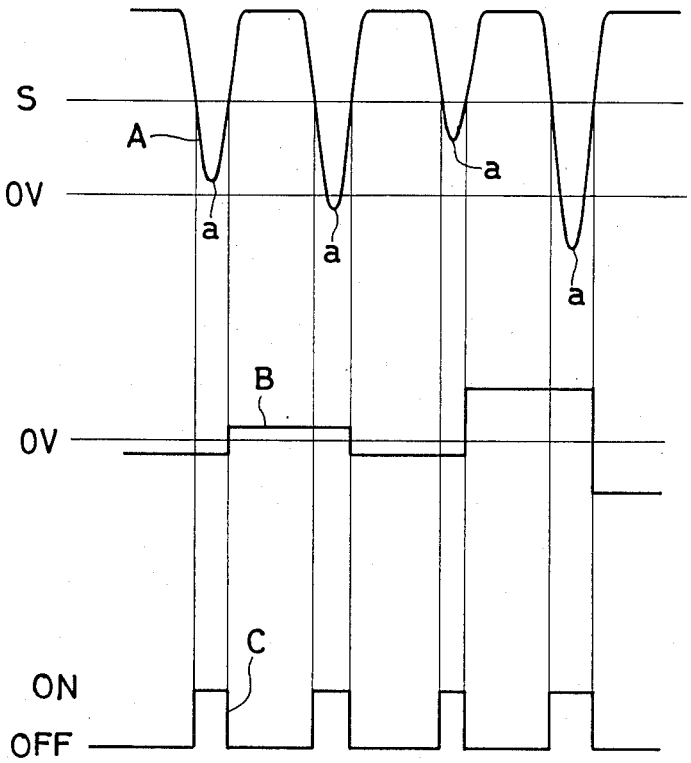
FIG. 8 is a time chart showing output signals from a bottom dead center detecting circuit included in the distance detecting unit.

With reference to FIG. 8, the bottom dead center (i.e. BDC) sensor circuit 40 produces a successive position signal A, holding signal B and count signal C. The successive position signal A, which is the usual signal from the sensor 39, directly represents the movement of the block 41, i.e. the slide 1, in the vicinity of the bottom dead center a. This signal A is proportional to the displacement of the slide 1 in the vicinity of the bottom dead center a; for example, 1 mV corresponds to a displacement of 1 μm. The count signal C is on only while the successive position signal A is lower than a threshold level S, namely only while the slide 1 is in the range of below a definite position which range includes the bottom dead center a. Accordingly during the usual operation of the press, the count signal C is on once for every stroke. The holding signal B is such that it holds the value of the successive position signal A at the bottom dead center during the period after the fall of the count signal C until the subsequent rise of the signal C. Accordingly the minimum relative distance, especially the variation thereof for every stroke, can be directly detected from the holding signal B.

As seen in FIG. 7, the temperature detecting unit 60 comprises a first temperature sensor 61 mounted on the drive assembly for the slide, a temperature sensor circuit 62 connected to the sensor 61, a second temperature sensor 63 provided within the frame (not shown) of the press, and a temperature sensor circuit 64 connected to the sensor 63. The first temperature sensor 61 is mounted on a suitable portion of the drive assembly for the slide 1, for example, on an intermediate bearing portion of the crankshaft for driving the connecting rod 5. The second temperature sensor 63 is disposed at a suitable location within the frame which location is away from the drive assembly for the slide 1. Thermocouples, thermistors or the like are used as the sensors 61, 63.

As shown in FIG. 7, the control unit 4 comprises a microcomputer 42 for controlling the overall correcting system. The successive position signals A and holding signals B from the BDC sensor circuits 40 of the distance detecting unit 3 and the outputs from the two temperature sensor circuits 62 of the temperature detecting unit 60 are fed to a multiplexer 43, which in turn feeds outputs to the computer 42 via an amplifier 44, sample holder 45, AD converter 46, photocoupler 47 and interface 48. The count signal C from one of the BDC sensor circuits 40 is applied to the computer 42 via a photocoupler 49 and the interface 48. In response to an instruction from the computer 42, the successive position signals A and the holding signals B from the two BDC sensor circuits 40 and the outputs from the two temperature sensor circuits 62 are successively converted to digital signals in proportion thereto, and the converted signals are given to the computer 42. The computer 42 takes an average of the succesive position signals A from the two circuit 40 as a detected value for the absolute position of the slide 1 and also takes an average of the holding signals B from the two circuits 40 as a detected value for the bottom dead center position of the slide 1. The computer 42 further calculates the difference between the output of the first temperature sensor circuit 62 and the output of the second temperature sensor circuit 64 as a detected value for the temperature of the drive assembly 1 for the slide 1.

Connected to the computer 42 of the control unit 4 are a start switch 51, display 52, display change-over switch 53 for the display 52, printer 54 and dial 55 for setting an amount of correction for a reference value for the bottom dead center of the slide 1. The reference value is determined for the correction to be made after the press is initiated into automatic operation as will be described later. The dial 55 is used for setting the amount of correction from outside for the reference value. A positive or negative correction amount can be set in 1 μm units, for example. The display 52 has the function of showing the relative position, absolute position and cumulative amount of correction. The display 52 is changed over by the switch 53 for showing these items of data. The data to be shown on the display 52 and the output of the printer 54 will be described later.

By way of an interface 56 and photocouplers 57, the computer 42 of the control unit 4 has connected thereto the four solenoid valves 33 to 36 of the slide position adjusting assembly 2, alarm relay 58, etc. When making the foregoing plus or minus adjustment for the slide 1, these valves 33 to 36 are controlled by instructions from the computer 42.

Figure 9:
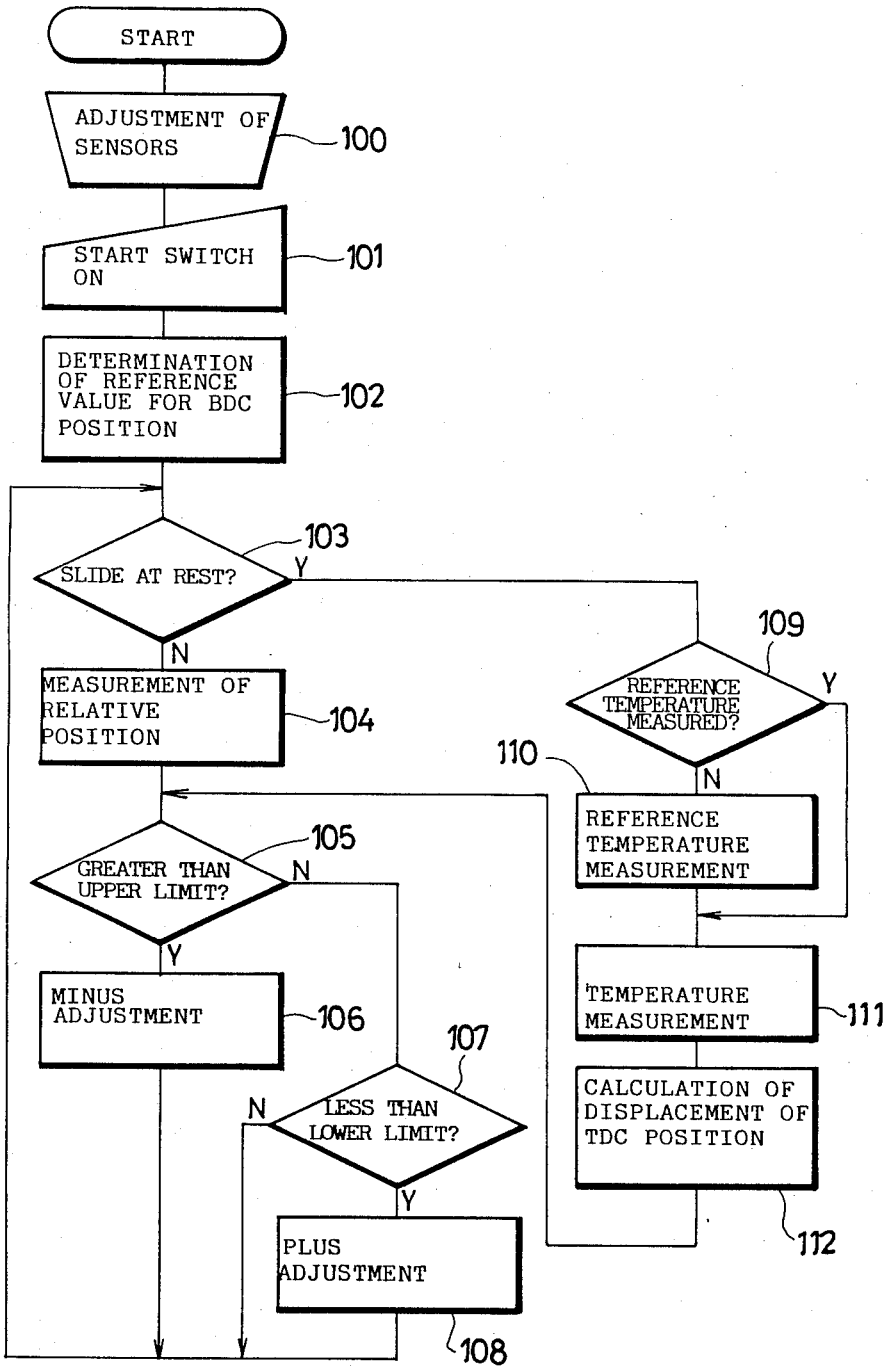
FIG. 9 is a flow chart showing procedures for press work and the operation of a system for automatically correcting the position of the slide.

Next with reference to the flow chart of FIG. 9, procedures for press work and the operation of the correcting system will be described.

Before the press is operated automatically, the slide 1 is held at rest at the bottom dead center, and the position of the distance sensors 39 is adjusted in upward-downward direction (step 100). This step is performed with the display 52 set for showing the absolute position. The detected values calculated by the computer 42 for the absolute position of the slide 1 as stated above can then be indicated in succession on the display 52, so that the slide 1 can be stopped at the bottom dead center easily. Moreover, the relative distance between the sensors 39 and the blocks 41 to be detected at the bottom dead center can be easily adjusted to an optimum value (e.g.1.5 mm).

After it has been confirmed that the desired product is available, the press is initiated into automatic operation, and the start switch 51 for the correcting system is depressed (step 101), whereby the system is brought into operation. First, the reference value is determined for the bottom dead center (BDC) position of the slide 1 in the following manner (step 102). The computer 42 of the control unit 4, monitoring the count signal C from the BDC sensor circuit 40 at all times, counts up the ON levels of the signal to determine the number of successive strokes of the press, and takes an average of the holding signals B from the two BDC sensor circuits 40 as a detected value for the bottom dead center position as already stated, every time the count signal C changes from ON to OFF level. The average of BDC position detected values is calculated, for example, for 100 strokes, an amount of correction set by the reference value correction setting dial 55 is added to the average value, and the resulting value is taken as the BDC position reference value.

Next, step 103 checks whether the slide 1 is at rest, namely whether the press operation is interrupted. When the press is in operation with the slide 1 in motion, step 104 follows to measure the BDC position of the slide 1 relative to the BDC position reference value. The measurement of relative position is obtained by calculating the average of BDC position detected values, for example, for 100 strokes as in the case of determination of the reference value and calculating the difference between the average value and the reference value.

Step 105 then checks whether the measurement of relative position is greater than the upper limit (e.g. +10 μm) of an allowable range which requires no correction. If it is greater, the valves 33 to 36 of the slide position adjusting assembly 2 are controlled as already described to effect minus adjustment of the slide position, for example, by 10 μm (step 106).

When the relative position measurement is not greater than the upper limit of the allowable range, step 107 checks whether the measurement is less than the lower limit (e.g. −5 μm) of the allowable range. If it is less, the position of the slide 1 is adjusted reversely, for example, by 10 μm through plus adjustment (step 108).

When the relative position measurement is within the allowable range, the sequence returns to step 103, which is followed by steps 104 et seq. These steps are repeated during the operation of the press. The minus adjustment (step 106) or plus adjustment (step 108) is similarly followed by these steps. If the relative position measurement is outside a predetermined range (for example, +20 μm to −15 μm), an alarm is given.

The BDC position of the slide 1 can be maintained within a predetermined range at all times by adjusting the position of the slide 1 based on the relative position measurement as stated above for every 100 strokes of the press, whereby products are obtained with high accuracy. When the display 52 is changed over to show the relative position during the operation of the correction system, the relative position measurement of the BDC position of the slide 1 is displayed, while if ;the display 52 is further changed over for indicating a cumulative amount of correction, the display shows the cumulative amount of correction made for the position of the slide during the operation started. When required, the relative position measurement and the cumulative value can be given as an output of the printer.

When the operation of the press is interrupted, the slide 1 is at rest, so that the checking of step 103 is followed by step 109, which checks whether the temperature (reference temperature) of the drive assembly for the slide 1 has been measured immediately after the cessation of operation.

In the first sequence immediately following the stopping of the slide 1, the reference temperature has not been measured, so that the reference temperature is measured and stored in step 110. Step 111 thereafter follows. In the second sequence and et seq. after the measurement of the reference temperature, step 109 is immediately followed by step 111, in which the temperature of the slide drive assembly is measured at the time concerned.

The displacement of the top dead center (TDC) position of the slide is then calculated from the measurement and the reference temperature based on a relationship determined in advance (step 112). There is a definite relationship between the variation of temperature of the drive assembly for the slide 1 at rest and the displacement of the TDC position, and this relationship is already stored in the computer 42.

Next, the sequence proceeds to step 105 to follow the same procedure as is followed during the operation of the press. Thus, minus adjustment (step 106) or plus adjsutment (step 108) is made if the displacement is in excess of the upper limit or lower limit of the foregoing allowable range. The sequence thereafter returns to step 103 to repeat step 109 and the subsequent steps while the slide 1 is at rest.

When the press operation is resumed with the slide 1 no longer at rest, step 103, step 104 and the following steps are repeated as already mentioned.

In this way, the TDC position of the slide 1 is corrected based on the measured temperature of the drive assembly for the slide 1 while the slide 1 is at rest, whereby the up-down relative position relationship between the slide 1 and the bolster is maintained in a definite range. This assures that the bottom dead center will be positioned in place with a degree of precision even immediately after the operation is resumed.

While the up-down relative position relationship between the slide 1 and the bolster is adjusted by upwardly or downwardly shifting the slide 1 relative to the connecting rods 5 according to the above embodiment, the bolster may be shifted upward or downward by suitable means for the adjustment.

Figure 10:
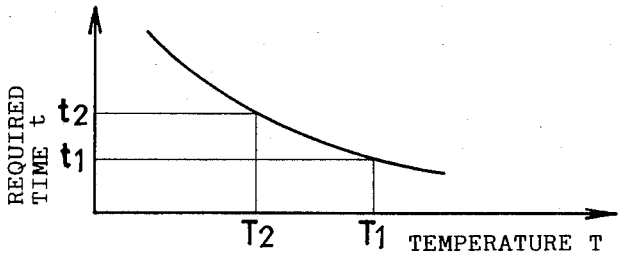
FIG. 10 is a graph showing, for illustrative purposes, the relationship between the temperature of the slide drive assembly while the press is out of operation and the time taken for the position of the top dead center of the slide to alter by a specified amount from the position at the temperature.

According to the embodiment described, the temperature of the drive assembly for the slide immediately after the stopping of the press is used as the reference temperature, and the displacement of the TDC position of the slide 1 is determined based on the subsequent temperature of the slide drive assembly and the reference temperature to thereby correct the up-down relative position relationship between the slide 1 and the bolster. However, the relationship can alternatively be corrected directly based on the temperature of the slide drive assembly without determining the displacement of the TDC position of the slide 1. Stated more specifically, the time taken for the TDC position of the slide to alter by a given amount after the press is brought to a halt is dependent on the temperature at the time when the press is stopped, and there is the relationship of FIG. 10 between the temperature T of the slide drive assembly while the press is out of operation and the time t required for the top dead center of the slide to shift by the given amount from its position at that temperature. FIG. 10 shows that if the temperature of the drive assembly for the slide at rest is T1, the time required for the top dead center of the slide to shift by the specified amount under the prevailing temperature condition is t1, and that if the temperature is T2, the required time is t2. The control unit 4 has stored in its computer 42 the relationship of FIG. 10, for example, in the case where the specified amount is 10 μm. Based on the relationship, the control unit controls the position adjusting assembly 2 in the following manner while the press is out of operation. First, immediately after the press is halted, the temperature of the slide drive assembly is measured, and the time required for the top dead center to shift by the specified amount under the temperature condition is determined. If the temperature is T1, for example, the required time is t1. Upon the lapse of the time t1, minus adjustment is made. Since the temperature of the drive assembly for the slide 1 decreases at all times while the press is out of operation, the ton dead center invariably shifts upward. Accordingly the minus adjustment brings the slide 1 back to the position immediately after the stopping of the press. On the other hand, simultaneously with the minus adjustment, the temperature of the slide drive assembly is measured, and the time required for the top dead center of the slide 1 to shift further by the specified amount under that temperature condition is determined. For example, if the temperature is T2, the required time is t2. Upon the lapse of the time t2, minus adjustment is made. The same procedure as above is thereafter repeated until the press operation is resumed. In this way, the up-down relative position relationship between the slide 1 and the bolster is maintained within a definite range, whereby the bottom dead center can be positioned in place with a degree of accuracy even immediately after the operation is resumed.

Figure 11:
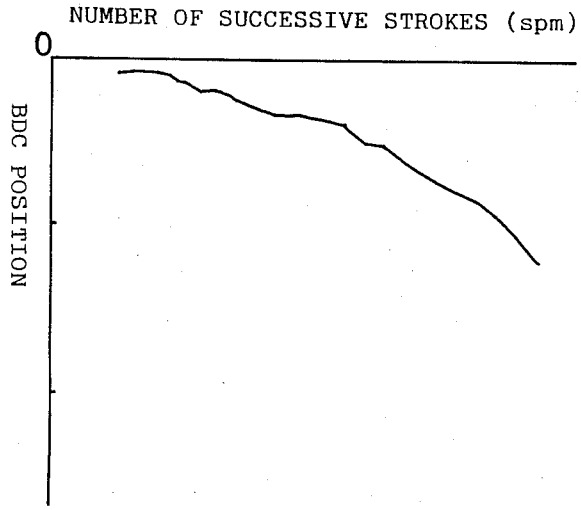
FIG. 11 is a graph showing, for illustrative purposes, the relationship between the number of successive strokes of the press and the position of the bottom dead center of the slide.
Figure 12:
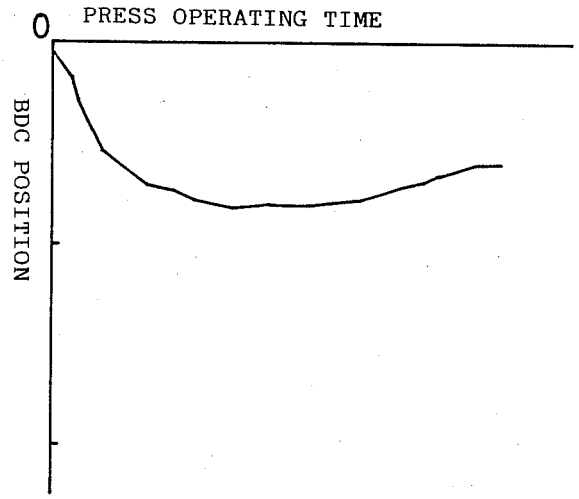
FIG. 12 is a graph showing, for illustrative purposes, the relationship between the press operating time and the position of the bottom dead center of the slide.

Although the BDC position of the slide 1, namely the minimum relative distance, is directly detected by the distance sensors 39 according to the embodiment described, the BDC position can be detected indirectly, for example, by detecting the number of successive strokes of the press and the temperature of the drive assembly for the slide 1. It is known that the number of successive strokes of the press and the BDC position of the slide have the relationship of FIG. 11 therebetween. The temperature of the slide drive assembly and the BDC position of the slide also have a definite relationship therebetween. When no temperature control is performed, the temperature varies with the press operating time, altering the BDC position for example as shown in FIG. 12. The BDC position is therefore indirectly detectable by detecting the number of successive strokes and the temperature of the slide drive assembly. In this case, the relationship of FIG. 11 between the number of successive strokes and the BDC position and the relationship between the temperature and the BDC position are stored in the control unit for the press, and the BDC position is determined from the detected number of successive strokes and detected temperature of the slide drive assembly based on these two relationships. With the exception of this procedure, the press is controlled in the same manner as already described. Furthermore, based on the detected number of successive strokes, the amount of correction corresponding to the stroke number may be determined from the relationship of FIG. 11, while based on the detected temperature, the amount of correction corresponding to the temperature may be determined from the relationship between the temperature and the BDC position to determine the overall required amount of correction from these amounts. The temperature may be detected by the sensors 61, 63 or by other sensors.

It is also possible to indirectly detect the BDC position of the slide 1, for example, by detecting the number of successive strokes of the press and the elongation of the conencting rod 5. Generally there is a definite relationship also between the BDC position of the slide and the elongation of the connecting rod, such that the BDC position alters downward when the rod expands while the bottom dead center shifts upward with the contraction of the rod. Accordingly the BDC position of the slide can be detected indirectly by detecting the number of successive strokes and the elongation of the connecting rod. The elongation of the rod is detected, for example, by a strain gauge. With the exception of the above, the procedure is the same as when the number of successive strokes and the temperature of the slide drive assembly are detected.

It is further possible to indirectly detect the BDC position of the slide 1 by detecting the compressive force acting on the connecting rod at the bottom dead center. Generally there is a definite relationship also between the BDC position of the slide and the compressive force on the connecting rod at the bottom dead center, such that the force increases as the BDC position lowers while the force decreases as the position rises. Accordingly the BDC position of the slide can be detected indirectly by detecting the compressive force acting on the connecting rod at the bottom dead center. The compressive force is detected, for example, by a strain gauge. Generally the compressive force on the connecting rod is greatest at the bottom dead center, so that the maximum of compressive force can be measured in the vicinity of the bottom dead center for detection. With the exception of the above, the same procedure as is the case with the first embodiment is followed.

What is claimed is:

1. A system for automatically correcting the position of a slide assembly relative to a bolster assembly of a press, comprising a position adjusting assembly mounted on one of said slide and bolster assemblies for adjusting the up-down relative position relationship between the slide assembly and a bolster assembly while the press is in operation, a distance detecting unit mounted on the other of said slide and bolster assemblies for detecting the relative distance between the bolster and the slide at the bottom dead center, and a control unit operatively connected to said position adjusting assembly and said distance detecting unit for controlling the position adjusting assembly based on the output of the distance detecting unit so that the relative distance between the bolster assembly and the slide assembly at the bottom dead center will be within a predetermined range during the operation of the press.

2. A system as defined in claim 1 wherein the distance detecting unit comprises two distance sensors attached to the bolster assembly toward opposite ends thereof, and the control unit includes means for taking an average of the outputs of the two distance sensors to determine the relative distance between the slide assembly and the bolster assembly.

3. A system as defined in claim 1 wherein the distance detecting unit includes means for indirectly detecting the relative distance between the bolster assembly and the slide assembly at the bottom dead center by detecting the number of successive strokes of the press and the temperature of the drive assembly for the slide assembly.

4. A system as defined in claim 1 wherein the distance detecting unit includes means for indirectly detecting the relative distance between the bolster assembly and the slide assembly at the bottom dead center by detecting the number of successive strokes of the press and the elongation of the connecting rod of the slide assembly.

5. A system as defined in claim 1 wherein the distance detecting unit includes means for indirectly detecting the relative distance between the bolster assembly and the slide assembly at the bottom dead center by detecting the compressive force acting on the connecting rod of the slide assembly at the bottom dead center.

6. A system for automatically correcting the position of the slide of a press by sensing temperature of the drive assembly of the slide, comprising a position adjusting assembly mounted on said slide for adjusting the up-down relative position relationship between the slide and bolster, a temperature detecting unit mounted on said drive assembly for detecting the temperature of the drive assembly while the slide is at rest, and a control unit operatively connected to said position adjusting assembly and said temperature detecting unit for controlling the position adjusting assembly based on the output of the temperature detecting unit while the slide is at rest for positioning the top dead center of the slide within a predetermined range.

7. A system as defined in claim 6 wherein the temperature detecting unit comprises a first temperature sensor mounted on the slide drive assembly and a second temperature sensor provided within the frame of the press, and the control unit includes means for calculating the difference between the output of the first temperature sensor and the output of the second temperature sensor to determine the temperature of the slide drive assembly.

8. A system as defined in claim 7 wherein the control unit includes means for using the temperature of the slide drive assembly immediately after the press is stopped as a reference temperature and determining the displacement of the top dead center of the slide by using the temperature of the slide drive assembly subsequently measured and the reference temperature for controlling the position adjusting assembly so that the position of the top dead center of the siide will be within a predetermined range.

9. A system as defined in claim 7 wherein the control unit includes means for storing therein the relationship between the temperature of the slide drive assembly while the press is out of operation and the time taken for the position of the top dead center of the slide to alter by a specified amount under the temperature condition, means for correcting the up-down relative position relationship between the slide and the bolster by a specified amount by determining the time taken for the top dead center position of the slide to be altered by said specified amount from the temperature of the slide drive assembly immediately after the press is stopped based on the stored relationship and by controlling the position adjusting assembly upon the lapse of said time after the stopping of the press, and further means for correcting the up-down relative position relationship between the slide and the bolster by said specified amount by determining the time taken for the top dead center position of the slide to be altered by the specified amount from the temperature of the slide drive assembly at the time of the correction based on the stored relationship and by controlling the position adjusting assembly upon the lapse of the secondmentioned time after the correction.

10. A system for automatically correcting the position of the slide relative to a bolster of a press and by sensing the temperature of the drive assembly of the slide, comprising a position adjusting assembly mounted on said slide for adjusting the up-down relative position relationship between the slide and a bolster while the press is in operation, a distance detecting unit mounted on said drive assembly for detecting the relative position between the bolster and the slide at the bottom dead center, a temperature detecting unit mounted on said drive assembly for detecting the temperature of the drive assembly for the slide at rest, and a control unit operatively connected to said position adjusting assembly, said distance detecting unit, and said temperature detecting unit for controlling the position adjusting assembly based on the output of the distance detecting unit while the press is in operation so that the relative distance between the bolster and the slide at the bottom dead center will be within a predetermined range, the control unit further being adapted to control the position adjusting assembly based on the output of the temperature detecting unit while the slide is at rest so that the position of the top dead center of the slide will be within a predetermined range.

11. A system as defined in claim 10 wherein the temperature detecting unit comprises a first temperature sensor mounted on the slide drive assembly and a second temperature sensor provided within the frame of the press, and the control unit includes means for calculating the difference between the output of the first temperature sensor and the output of the second temperature sensor to determine the temperature of the slide drive assembly.

12. A system as defined in claim 11 wherein the distance detecting unit comprises two distance sensors attached to the bolster toward opposite ends thereof, and the control unit includes means for taking an average of the output of the two distance sensors to determine the relative distance between the slide and the bolster.

13. A system as defined in claim 11 wherein the distance detecting unit includes means for indirectly detecting the relative distance between the bolster and the slide at the bottom dead center by detecting the number of successive strokes of the press and the temperature of the slide drive assembly.

14. A system as defined in claim 11 wherein the distance detecting unit includes means for indirectly detecting the relative distance between the bolster and the slide at the bottom dead center by detecting the number of successive strokes of the press and the elongation of the connecting rod of the slide.

15. A system as defined in claim 11 wherein the distance detecting unit includes means for indirectly detecting the relative distance between the bolster and the slide at the bottom dead center by detecting the compressive force acting on the connecting rod of the slide at the bottom dead center.

16. A system as defined in any one of claims 11, 12, 13, 14 and 15 wherein the control unit includes means for using the temperature of the slide drive assembly immediately after the press is stopped as a reference temperature and determining the displacement of the top dead center of the slide based on the temperature of the slide drive assembly, subsequently measured and of the reference temperature for controlling the position adjusting assembly so that the position of the top dead center of the slide will be within a predetermined range.

17. A system as defined in any one of claims 11, 12, 13, 14 and 15 wherein the control unit includes means for storing therein the relationship between the temperature of the slide drive assembly while the press is out of operation and the time taken for the position of the top dead center of the slide to alter by a specified amount under the temperature condition, means for correcting the up-down relative position relationship between the slide and the bolster by the specified amount by determining the time taken for the top dead center position of the slide to be altered by the specified amount from the temperature of the slide drive assembly immediately after the press is stopped based on the stored relationship and by controlling the position adjusting assembly upon the lapse of said time after the stopping of the press, and means for further correcting the up-down relative position relationship between the slide and the bolster by the specified amount by determining the time taken for the top dead center position of the slide to be altered by the specified amount from the temperature of the slide drive assembly at the time of the correction based on the stored relationship and by controlling the position adjusting assembly upon the lapse of the second-mentioned time after the correction.

* * * * *